US007666263B2

(12) United States Patent
Walters

(10) Patent No.: US 7,666,263 B2
(45) Date of Patent: Feb. 23, 2010

(54) DEVICE TO CATCH AND RETRIEVE FOAM PELLETS

(75) Inventor: William O. Walters, Seattle, WA (US)

(73) Assignee: The Boeing Company, Chicago, IL (US)

( * ) Notice: Subject to any disclaimer, the term of this patent is extended or adjusted under 35 U.S.C. 154(b) by 710 days.

(21) Appl. No.: 11/214,180

(22) Filed: Aug. 30, 2005

(65) Prior Publication Data

US 2006/0027250 A1 Feb. 9, 2006

Related U.S. Application Data

(63) Continuation of application No. PCT/US2004/04793, filed on Feb. 18, 2004.

(60) Provisional application No. 60/448,134, filed on Feb. 20, 2003, provisional application No. 60/448,135, filed on Feb. 20, 2003, provisional application No. 60/448,136, filed on Feb. 20, 2003.

(51) Int. Cl.
*B08B 9/055* (2006.01)

(52) U.S. Cl. ..... 134/8; 15/3.5; 15/3.51

(58) Field of Classification Search ..... 15/3.5, 15/3.51; 134/8
See application file for complete search history.

(56) References Cited

U.S. PATENT DOCUMENTS 5,926,892 A * 7/1999 Fukuhara et al. ..... 15/3.5

* cited by examiner

*Primary Examiner*—Randall Chin
(74) *Attorney, Agent, or Firm*—Harness, Dickey & Pierce, P.L.C.

(57) ABSTRACT

An apparatus for the rapid loading, launching and retrieval of foam pellets for tube cleaning. The apparatus uses a block configuration to allow gravity feed and rapid firing of pellets into tubes. The apparatus includes a hopper feeder attachment, which is self-adjusting during pellet jams.

20 Claims, 5 Drawing Sheets

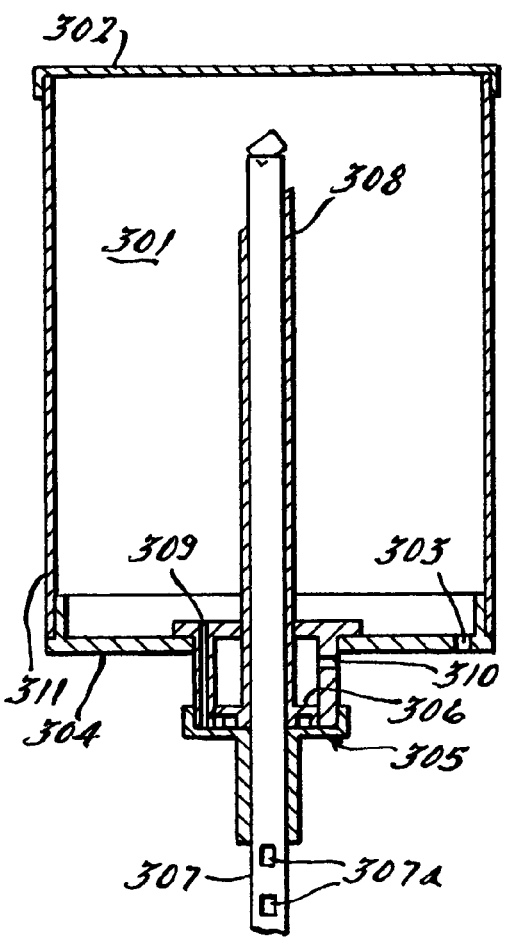
Fig. 10.
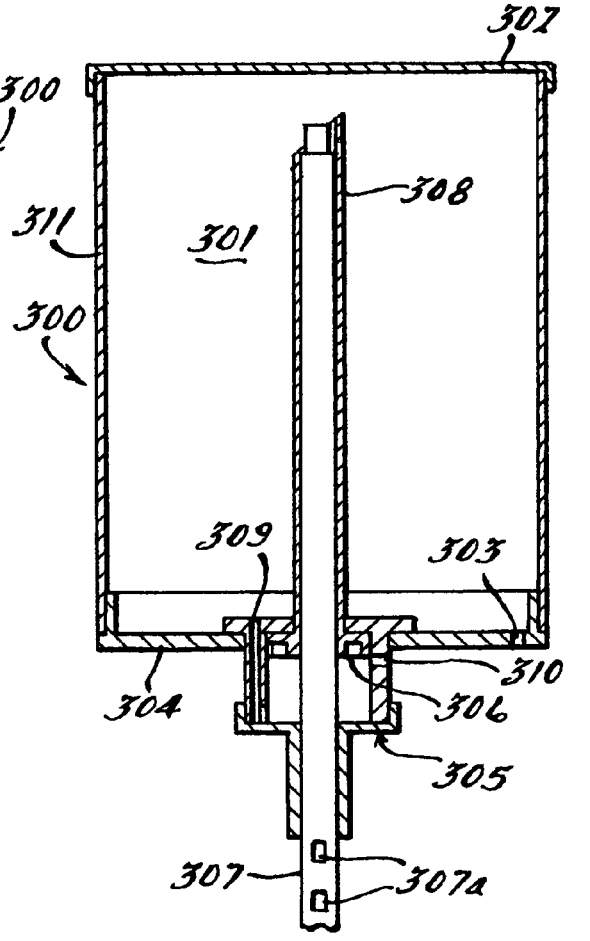
Fig. 11.
Fig. 10b.
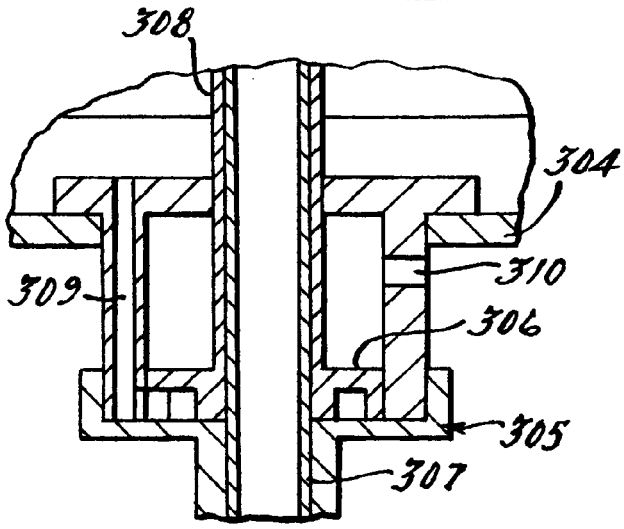
Fig. 10a.
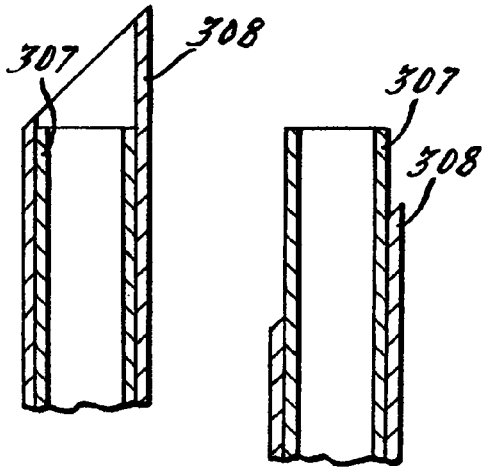
Fig. 10c.

DEVICE TO CATCH AND RETRIEVE FOAM PELLETS

This application is continuation of PCT application serial number PCT/US2004/004,793, filed Feb. 18, 2004, which in turn claims priority from U.S. provisional application Ser. Nos. 60/448,134, 60/448,135, and 60/448,136 filed on Feb. 20, 2003.

FIELD

This invention relates to an apparatus for the cleaning of tubes. More particularly, to an attachment used in the cleaning of tubes using pellets and the retrieval and reuse thereof. Thereby reducing the cost and providing a savings from loss of down time and cost of recovery.

BACKGROUND

Industry has been looking for ways to clean hydraulic tubing that can replace the current method of vapor degreasing. A vapor degreaser is a large organic solvent still on which the solvent vapor condenses and drains off the parts to be cleaned. Vapor degreaser systems are large, fixed installations that have a high purchase price and maintenance costs. Companies that use this method also must obtain a yearly operating permit for their facilities from the Clean Air Agencies because of the potential for air pollution and health risks that this cleaning method poses. Replacing these vapor degreasers with small, low-cost cleaning methods allows installations to consolidate sites and save money.

The pellet system is currently used to clean tubes at a relatively high rate in close quartered work cells. Tubes are bent into a large variety of complicated shapes and lengths. Pellets must be loaded, launched/retrieved and examined with a minimum of operator movement. Equipment that requires the operator to find and retrieve the spent pellet lowers productivity. Safety and noise consideration require that the pellets be fired into a containment device and that the noise be reduced to acceptable levels.

One method is to propel a polyurethane foam pellet through the tube using compressed air. The tight fitting foam pellet scrubs the interior wall of the tube as it passes through. This is a widely used technique and there are at least three makers of pellets and pellet launching equipment worldwide. One component lacking from the vendors is equipment to capture and return the spent pellet to the operator so that it may be examined.

SUMMARY

The present invention provides an innovative, unique and useful alternative to commercially available foam pellet launchers for tube cleaning. This attachment provides a quick and efficient automatic loader and launcher for foam pellets. The invention comprises foam pellets that are gravity fed through a tubular magazine into a cylindrical vertical passageway in a block. This passageway is intersected at a right angle by a cylindrical horizontal passageway about the middle of the block. Below this horizontal passageway the vertical bore has a valved port. The valve releases compressed air into the passageway on a piloted air command. Free to slide in the horizontal passageway, a cylindrical shuttle is attached at one end to a pneumatic actuator. At its opposite end is a hole slightly larger than and aligning with the vertical bore when the shuttle is extended. Also at this end, the shuttle has a pin through it that extends through slots on opposite sides of die block. This pin can contact a spring loaded release lever and rotate it about an axle through the block. The release lever straddles the block and has a projection that protrudes through a small hole intersecting the vertical passageway in the block previously described.

Another aspect of the invention is a hopper attachment used to rapidly load pellet launchers. Additionally the attachment self-corrects jammed pellets, thereby providing a savings from loss of down time and cost of recovery.

Another aspect of the invention comprises a fitting with a flexible seal opening to receive the (exit) end of the tube being cleaned, and a return tube to carry the pellet back to the operator where a receiver captures the pellet, separates it from the air stream and releases it to the operator.

Each aspect of the present invention provides an innovative, unique and useful attachment to commercially available foam pellet launchers for tube cleaning. This attachment speeds up the process for pellet retrieval and provides productivity improvements because the pellet method allows the user to go from the current batch-processing method to one-piece processing in work cells.

Further areas of applicability of the present invention will become apparent from the detailed description provided hereinafter. It should be understood that the detailed description and specific examples, while indicating various embodiments of the invention, are intended for purposes of illustration only and are not intended to limit the scope of the invention.

BRIEF DESCRIPTION OF THE DRAWINGS

The present disclosure will become more fully understood from the detailed description and the accompanying drawings, wherein:

FIG. 10 shows a hopper/feeder;

FIG. 10*a* is an enlarged cross-sectional side view of the piston coupled to the outer tube of FIG. 10;

FIG. 10*b* is an enlarged side, cross-sectional view of the upper ends of the outer and inner tubes of FIG. 10, but with the outer tube extended to assist in unblocking the opening of the inner tube;

FIG. 10*c* is a view of the outer and inner tubes of FIG. 10*b*, but with the outer tube in the position it assumes when there is no pellet jammed in the inner tube; and FIG. 11 shows another detail of the hopper/feeder but with the pellet righted.

DETAILED DESCRIPTION

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims.

Figure 1:
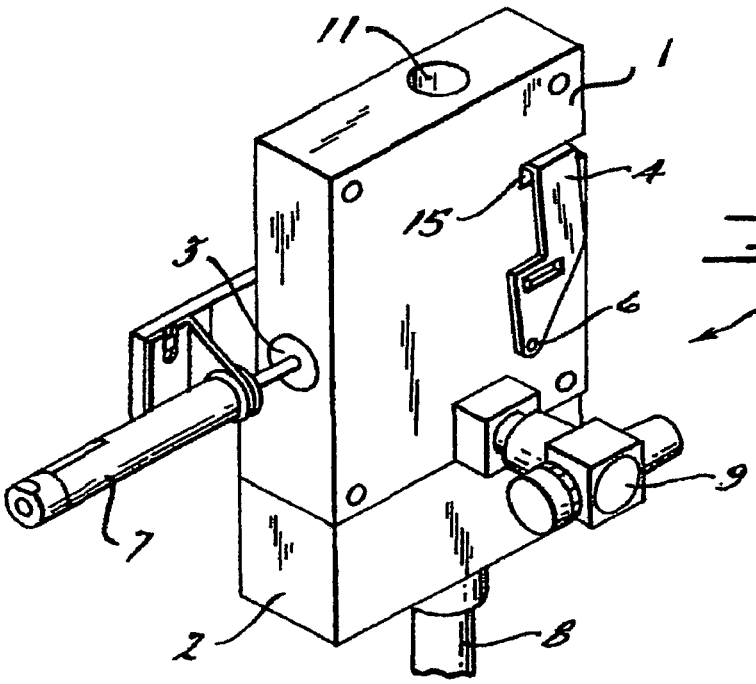
FIG. 1 shows an embodiment of the invention.
Figure 2:
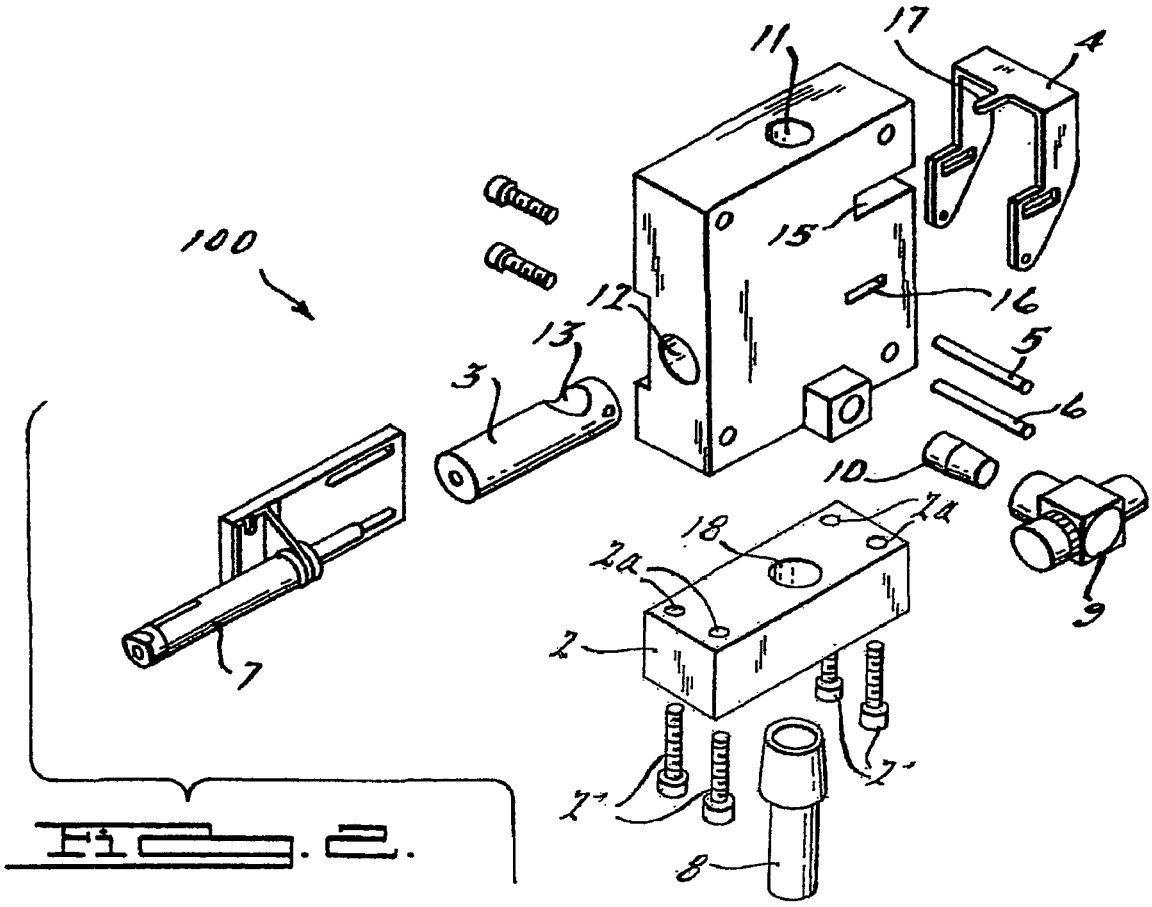
FIG. 2 shows an exploded view of some of the major components of the invention.

Referring to FIGS. 1 and 2, a device (100) for automatically loading and firing foam pellets comprises a block (1) that contains a cylindrical vertical passageway (11). Foam pellets are gravity fed through a tubular magazine (shown as item 307 in FIGS. 10 and 11) into said cylindrical vertical passageway (11) of the block (1). This passageway (11) is intersected at a right angle by a cylindrical horizontal passageway (12) about the middle of the block (1). Below this horizontal passageway (12) the vertical passageway (11) has a valved port (10). A valve (9) releases compressed air into the vertical passageway (11) on a piloted air command. Free to slide in the horizontal passageway (12), a cylindrical shuttle (3) is attached at one end to a pneumatic actuator (8). At its opposite end is a hole (13) slightly larger than and aligning with the vertical passageway (11). When the shuttle (3) is extended the shuttle (3) has a pin (5) through it that extends through slots (16) on opposite side of the block (1). This pin (5) contacts a spring loaded release lever (4) and rotates it about an axle (6) through the block (1). The release lever (4) straddles the block (1) and has a projection (17) that protrudes through a small hole (15) intersecting the vertical passageway (11) of the block (1).

Figure 3:
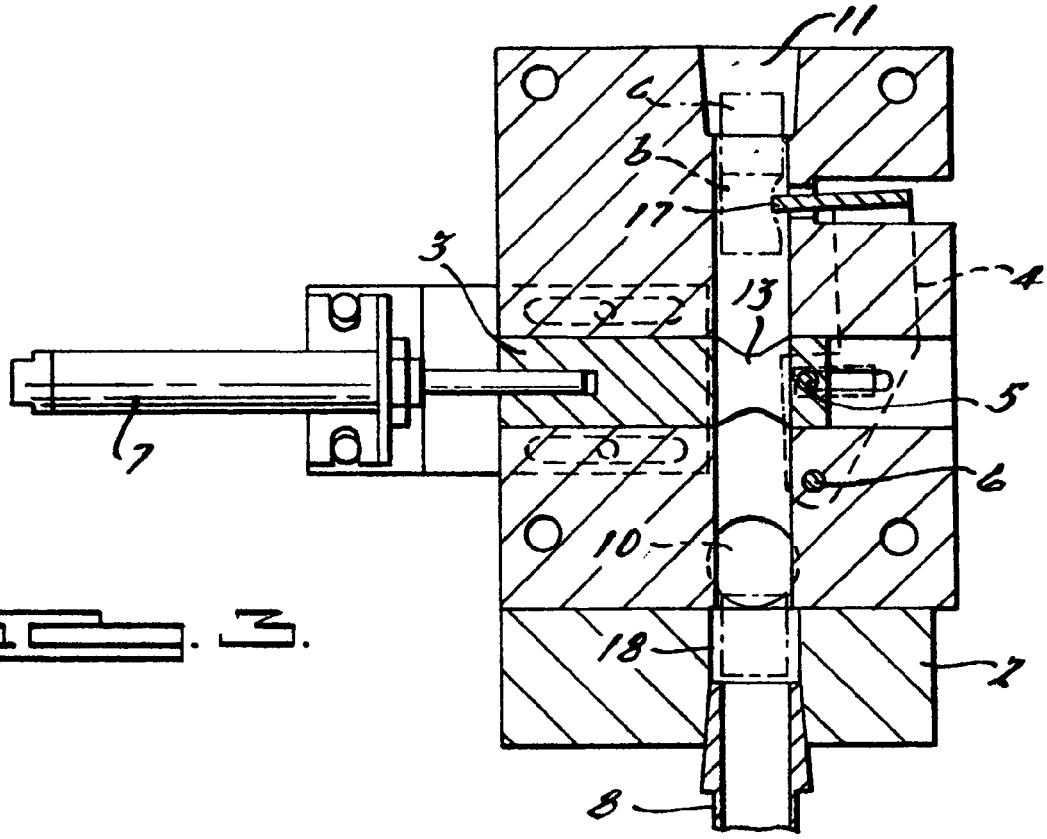
FIG. 3 shows a detailed cross-sectional view of the invention with its release lever in the locked position.
Figure 4:
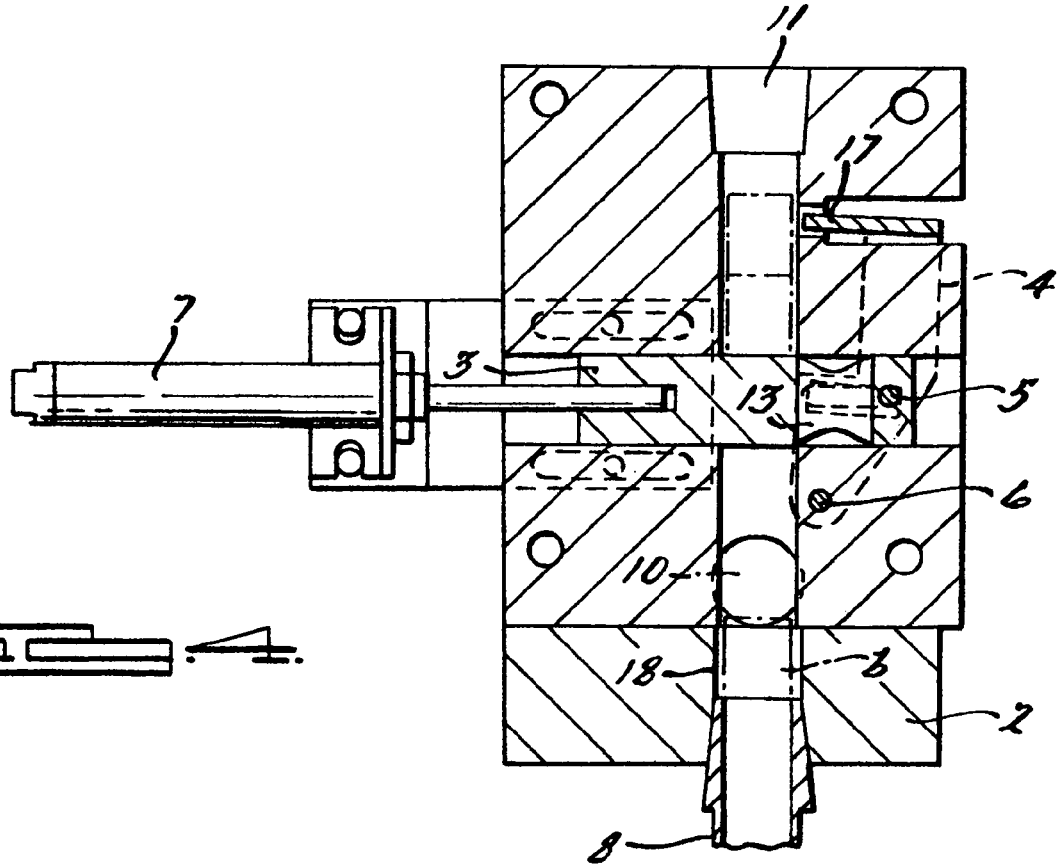
FIG. 4 shows a detailed cross-sectional view of the invention with its release lever in the unlocked position.

Referring to FIG. 3, operation starts with one pellet (a) in the chamber below the air injection port (11). The shuttle (3) is in the retracted position, a hole (13) is aligned with the vertical passageway (11). The pin (5) on the shuttle (3) does not contact the lever (4) allowing the projection (17) on the lever (4) to jam the lowest pellet (b) above the shuttle (3) in the vertical passageway (11). No pellets can fall through the hole (13) in the shuttle (3) to the bottom. Referring to FIG. 4, on triggering, the shuttle (3) is pushed into the forward position by a pneumatic actuator (7), first blocking the vertical passageway (11). Then as it moves farther, the pin (5) pushes the release lever (4) back releasing the pellets. The pellets drop together until the lowest one (b) rests on top of the shuttle (3). Once the shuttle (3) is fully forward, the pneumatic actuator (7) on the shuttle (3) detects this condition and opens the valved port (10). The compressed air behind pellet (a) forces it through the lower block (2) that contains a cylindrical vertical passageway (18) that is aligned with the vertical passageway (11) of block (1). The lower block (2) also contains four openings (2*a*) (FIG. 2) located at the corners of the lower block (2) for the insertion of bolts (2'). Attached to the lower block (2) is the lower fitting (9) that the flexible hose (not shown) is attached, acting as the gun barrel. The pellet exits a muzzle at the other end of the hose (not shown) and is propelled through the tube being cleaned. The shuttle (3) remains in the forward position and air continues to flow as long as the trigger is held down.

When the trigger is released the shuttle (3) moves rearward but before the hole (13) in it realigns with the vertical passageway (11), the projection on the release lever (4) jams the pellet (c) immediately above the one resting on the shuttle (3). As the shuttle (3) continues to move to the rear position, the hole (13) comes into alignment, and a single pellet (b) falls into the lower portion of the lower block (2). The device is now in the starting position again.

Figure 5:
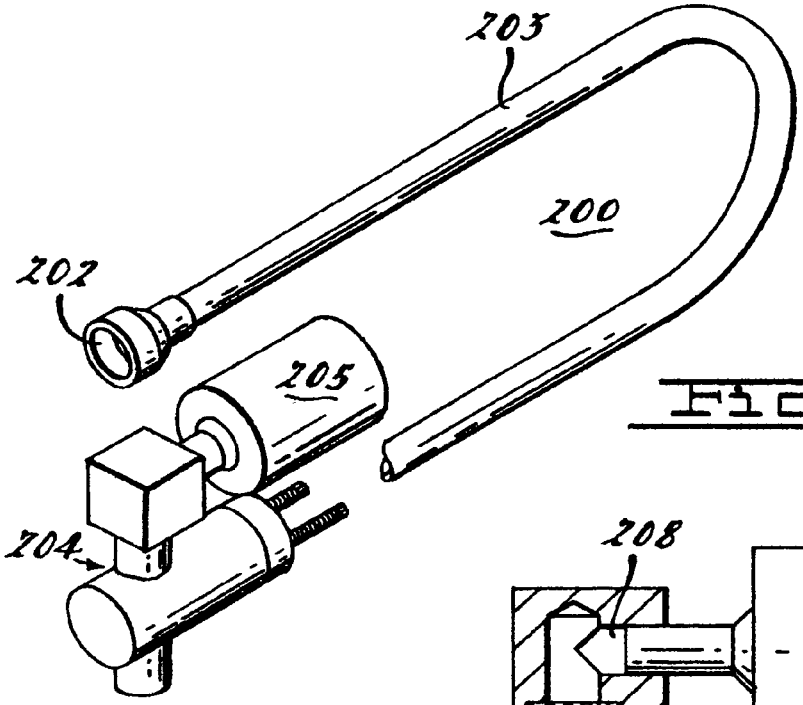
FIG. 5 shows a perspective view of an embodiment of a foam pellet catcher and retriever, according to the present invention.
Figure 6:
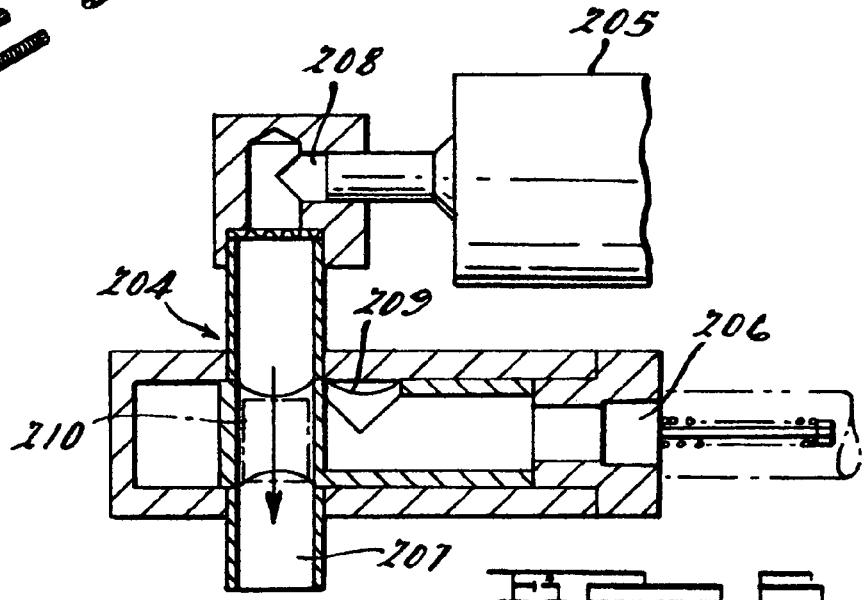
FIG. 6 shows a cut away of the receiver, according to the present invention.
Figure 7:
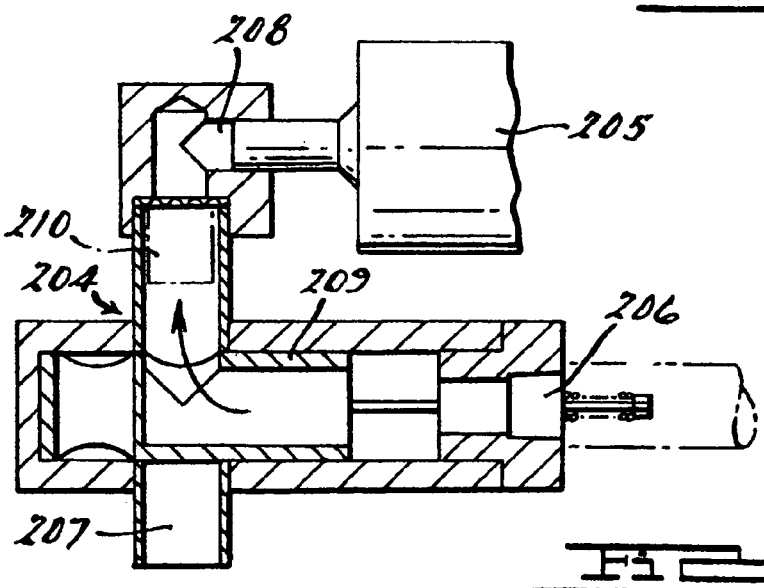
FIG. 7 shows a cross-sectional view of an embodiment of the retrieval chamber of FIG. 6.

FIG. 5 shows a perspective view of a foam pellet catcher and retriever ("FPCR") 200. The FPCR 200 includes a bell fitting 202, transfer tube 203, chamber 204 and a muffler 205. The chamber 204 includes an input opening 206 and an output opening 207, as shown in FIGS. 6 and 7. The chamber 204 is also known as a collection chamber. The muffler 205 is connected to the chamber 204 at opening 208.

Figure 8:
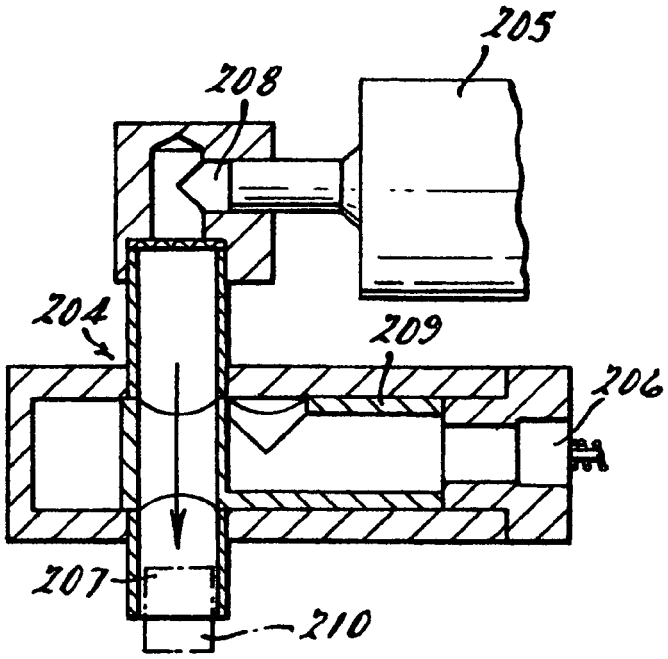
FIG. 8 shows a cross-sectional view of an embodiment of the retrieval chamber of FIG. 6.

Referring to FIGS. 6, 7 and 8, a slide valve 209 is positioned within the chamber 204. In operation, air pressure applied to the input opening 206 from the jet stream holds the slide valve in position 1 (FIG. 7). As the air pressure jet stream is applied, air escapes through opening 208 and out the muffler 205. The pellet 210 is trapped in chamber 204. When the air pressure is released the slide valve 209 is released and moves to position 2 (FIG. 8), thus allowing the foam pellet 210 to fall through opening 207.

The collection chamber 204 is typically constructed of metal or plastic. In a preferred embodiment, the bell fitting 202 is a standard bell fitting and is connected to one end of the transfer tube 203. The transfer tube 203 may be bent into a large variety of complicated shapes and lengths and is typically made of copper or other bendable material that can withstand high air-pressure. Typically, the bell fitting 202 has a flexible seal opening to receive the exit end of a tube being cleaned and is connected to the transfer tube by clamps; however, other types of connections may be used provided they are non-obstructive. The other end of the transfer tube 203 is connected to the input opening 206 of the chamber 204 and is connected to the transfer tube 203 by clamps; however, other types of connections may be used provided they are non-obstructive. The muffler 205 is connected to opening 208 of the chamber 204. Typically, the muffler 205 is a standard auto glass packed muffler; however, other types of mufflers known in the art may be used. The muffler 205 may be connected to opening 208 by screwing the muffler 205 into the output opening 208, by soldering the muffler 205 to the opening 208, or by other attachment methods known in the art. The muffler 205 is used to control and reduce noise to acceptable levels for safety reasons because the present invention is used to clean tubes at a relatively high rate in close quartered work cells.

FIGS. 7 and 8 further illustrate the operation of the FPCR 200. As shown in FIG. 7, a spent pellet 210 enters the chamber 204 through the input opening 206. In a preferred embodiment the spent pellet 210 emerges from a cleaned tube (not shown) and is propelled into the transfer tube 203 via the bell fitting 202 under air-pressure. The spent pellet 210 is then transferred from the transfer tube 203 into the chamber 204 through the input opening 206. In FIG. 7, the slide valve 209 moves to position 1 within the chamber 204 as long as there is air-pressure from the transfer tube 203. As shown in FIG. 7, when the air-pressure is removed, the slide valve 209 in the chamber 204 moves to position 2. The spent pellet 210 then falls through the output opening 207 of the chamber 204. Typically, the spent pellet is a foam pellet made of polyurethane. The spent pellet 210 may then be examined by an operator, at which time appropriate action can be taken.

Figure 9:
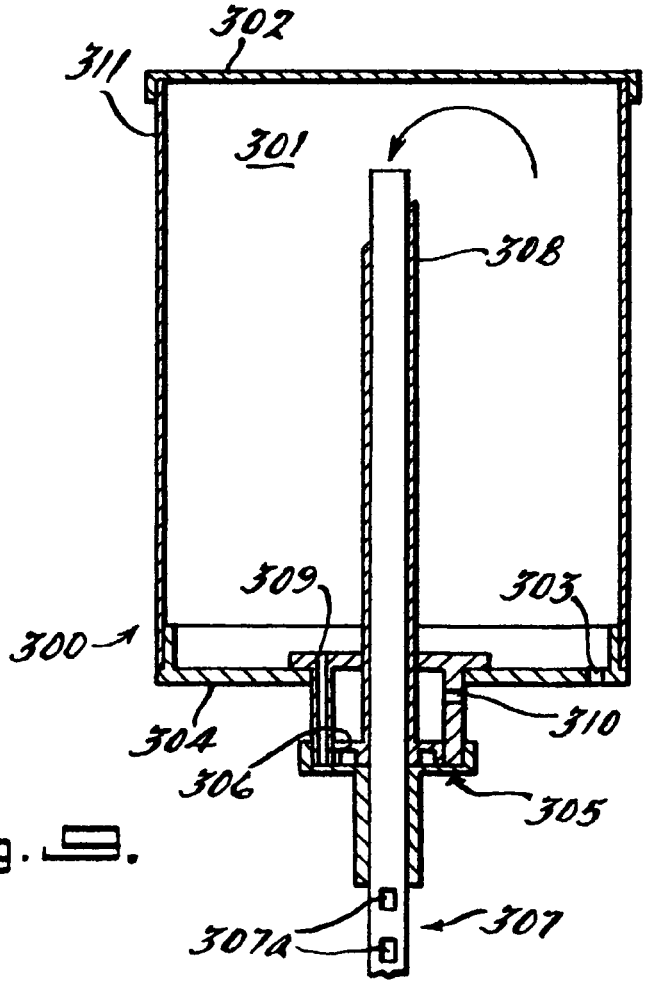
FIG. 9 shows another embodiment of a hopper/feeder.

FIGS. 9-11 show an embodiment of an attachment for fast loading foam pellets. This embodiment is comprised of a hopper made of a cylindrical container (300) about 8 inches 20-32 mm high with a removable top (302) secured with buckles to an outer wall (311). There are four air inlets (303) (only one being visible in FIGS. 9-11) around the periphery of a container floor (304) equally spaced close to an inside surface of the wall (311). These direct air upward and serve to circulate the foam pellets in an interior area (301) of the container 300. Mounted in the center of the container floor (304) is a cylinder piston device (305) having a piston 306. The device 305 passes through the floor (304). A thin-walled vertical tube (307) passes through the cylinder piston device 305 and extends into the container (300) to approximately two inches (5.08 mm) from the cover (302). An outer tube (308), slightly larger is slipped over the tube (307) and is attached to the piston (306) (FIG. 10*a*). The outer tube (308) is free to slip over the tube (307) and is cut at a 45 degree angle at the top (FIG. 10*b*). The tube lengths are such that when the outer tube (308) and its attached piston (306) are at the lower end of travel, the top of tube (208) is below that of tube (307).

The cylinder piston (305) device in the floor (304) of the container (300) has several air ports. One port (309) carries air from the interior of the container (300) to a space below a piston (306) within the cylinder piston device (305). The space above the piston (306) is vented to the outside via several radial ports (310) in the cylinder piston device (305).

In operation, three to four hundred foam pellets are placed into the container (300) and the cover (302) is attached. Air entering from the ports (303) in the floor (304) flows out through the center tube (307). The air stream carries pellets into the center tube (307) where they pass down the tube (307) and stack up for loading into a pellet launcher. Below the container floor (304), the tube (307) has ventilation ports (307*a*) in the tube wall all along its length to allow the air to escape. Pellets will jam at the top opening if they are not oriented properly, as they pass into the tube 307 (FIG. 10). When a jam occurs, the tube (307) is partially blocked, causing the pressure to rise in the container (300). This increase in pressure is communicated to the underside of the piston (306) through one set of ports (309). This causes the piston 306 to rise, lifting the outer tube (308) and righting the jammed pellet, and allowing it to pass down into tube 307. Once air is flowing in the tube (307) again, the outer tube (308) falls to its resting position.

The cylinder piston device (305) device serves an additional role as a pressure relief valve. If pellets are not used fast enough by the launcher, they stack up in the tube (307). Although the tube (307) is vented, eventually the pellets will back up into the region of the tube that is inside the container (300). When this happens, the tube (307) is again blocked and the piston (306) raises past the ports 310 and the air escapes.

While various preferred embodiments have been described, those skilled in the art will recognize modifications or variations which might be made without departing from the inventive concept. The examples illustrate the invention and are not intended to limit it. Therefore, the description and claims should be interpreted liberally with only such limitation as is necessary in view of the pertinent prior art.

What is claimed is:

1. A method of loading cleaning pellets used in a tube cleaning process and correcting said pellet alignment comprising:

introducing said pellets in a cylinder;

providing first and second tubes, whereby said first tube is disposed in said cylinder;

attaching a piston to said second tube and encircling said first tube; and introducing a jet stream into said cylinder and allowing said pellets to exit through said first tube.

2. The method as recited in claim 1, wherein said cylinder further comprises a removable top and a floor.

3. The method as recited in claim 2, wherein said cylinder floor has a plurality of ports around its periphery allowing said jet stream to enter the cylinder.

4. The method as recited in claim 3, wherein said first tube is located along a center axis of said cylinder and exits through the cylinder floor.

5. The method as recited in claim 4, wherein said second tube has top and bottom ends, and whereby said top end has an opening cut at a 45 degree angle.

6. The method as recited in claim 5, wherein one of said plurality of ports communicates an increase in air pressure in said cylinder to the piston causing it to push said second tube along said first tube, whereby movement of said second tube assists in reorienting a jammed pellet relative to said first tube so that said jammed pellet becomes unjammed and passes into said first tube.

7. A method of loading cleaning pellets used in a tube cleaning process and unjamming a jammed cleaning pellet, the method comprising:

introducing said pellets in a cylinder;

providing first and second tubes, whereby said first tube is disposed concentrically relative to said second tube, and both tubes include portions that are disposed within said cylinder;

attaching a piston to said second tube;

introducing an airflow jet stream into said cylinder and allowing said pellets to exit through said first tube;

when one of said pellets becomes jammed at an end of said first tube as it begins to move into said first tube, then actuating said piston to cause said second tube to move linearly along said first tube to cause an end of said second tube to contact said one jammed pellet and reorient said one jammed pellet, so that said one jammed pellet is able to move freely into said first tube.

8. The method of claim 7, further comprising:

forming said piston as a portion of a valve such that an air escape port is opened when said second tube moves a predetermined distance, with said airflow jet stream of air exiting said air escape port to limit a buildup of air pressure within said second valve.

9. The method of claim 8, further comprising:

forming said piston such that a portion of said second tube is coupled to said piston.

10. The method of claim 9, further comprising:

forming said valve with an air flow port that allows said airflow jet stream to flow into said valve when one of said pellets becomes jammed in said first tube, such that said airflow jet stream is able to move said second tube a sufficient distance so that said end of said second tube reorients said one of said pellets that is jammed in said end of said first tube.

11. The method of claim 7, further comprising providing a plurality of ports in said cylinder at a bottom area of said cylinder for supplying said airflow jet stream into said cylinder, said airflow jet stream causing said pellets to be lifted and deposited into said end of said first tube.

12. The method of claim 7, further comprising forming said end of said second tube with a surface edge that is non-parallel to said end of said first tube.

13. The method of claim 7, further comprising forming an air flow jet stream exit port at a lower end of said first tube.

14. A method of loading cleaning pellets used in a tube cleaning process and reorienting one of said cleaning pellets that becomes jammed during a pellet loading operation, the method comprising:

introducing said pellets in a cylinder;

providing first and second tubes, whereby said first tube is disposed concentrically relative to said second tube, and both tubes include portions that are disposed within said cylinder;

attaching a piston to said second tube;

introducing an airflow jet stream into said cylinder and allowing said pellets to exit through said first tube;

when one of said pellets becomes jammed at an end of said first tube as it begins to move into said first tube, then actuating said piston to cause said second tube to move linearly along said first tube to cause an end of said second tube to contact said one jammed pellet and reorient said one jammed pellet, so that said one jammed pellet is able to move freely into said first tube.

15. A method of loading cleaning pellets used in a tube cleaning process and correcting a misalignment of one of said cleaning pellets that interrupts said loading, the method comprising:

providing a quantity of said cleaning pellets in a cylinder;

arranging first and second tubes concentrically with one another and in an upright orientation within said cylinder;

securing a portion of said second tube to a piston;

arranging said piston in a valve;

introducing an airflow jet stream into said cylinder to urge said pellets into an upper end of said first cylinder;

when one of said pellets becomes jammed in said upper end, then using said airflow jet stream to control said valve to move said piston, with movement of said piston causing a linear movement of said second tube, and said linear movement of said second tube causing an upper end of said second tube to contact said one jammed pellet and reorient said one jammed pellet, and such that said one jammed pellet falls into said first tube.

16. The method of claim 15, further comprising:

forming a plurality of air flow ports in said cylinder through which said airflow jet stream is directed into an interior area of said cylinder.

17. The method of claim 15, further comprising:

forming an air flow exit port in said valve that provides a pressure relief air flow path.

18. The method of claim 17, further comprising:

forming said upper end of said second tube with an edge surface non-parallel to said upper end of said first tube.

19. The method of claim 18, further comprising:

forming a lower end of said first tube with a plurality of air flow ports through which a portion of said airflow jet stream entering said first tube may exit through.

20. The method of claim 15, further comprising placing a cover over said cylinder.

* * * * *